US005623209A

United States Patent [19]

Lepley et al.

[11] Patent Number: 5,623,209

[45] Date of Patent: Apr. 22, 1997

[54] DIAGNOSTIC SYSTEM FOR CAPACITIVE DISCHARGE IGNITION SYSTEM

[75] Inventors: Joseph M. Lepley, Girard, Ohio; Gary A. Kleinfelder, Mercer, Pa.

[73] Assignee: Altronic, Inc., Girard, Ohio

[21] Appl. No.: 568,492

[22] Filed: Dec. 7, 1995

[51] Int. Cl.[6] ..... F02P 17/00

[52] U.S. Cl. ..... 324/382; 324/379; 324/388; 324/655

[58] Field of Search ..... 324/393, 396, 324/382, 397, 379, 399, 388, 402; 123/604

[56] References Cited

U.S. PATENT DOCUMENTS

| | | | |
|---|---|---|---|
| 3,784,901 | 1/1974 | Miller et al. | 324/16 R |
| 4,186,337 | 1/1980 | Volk et al. | 324/380 |
| 4,333,054 | 6/1982 | Walker | 324/380 |
| 4,758,790 | 7/1988 | Hunt | 324/379 |
| 5,054,461 | 10/1991 | Deutsch et al. | 123/609 |
| 5,113,839 | 5/1992 | Hartmann et al. | 123/606 |
| 5,208,540 | 5/1993 | Hoeflich | 324/388 |
| 5,216,369 | 6/1993 | Toyama | 324/388 |
| 5,221,904 | 6/1993 | Shimasaki et al. | 324/378 |
| 5,327,090 | 7/1994 | Shimasaki et al. | 324/378 |

*Primary Examiner*—Kenneth A. Wieder
*Assistant Examiner*—Jose M. Solis
*Attorney, Agent, or Firm*—Webb Ziesenheim Bruening Logsdon Orkin & Hanson, P.C.

[57] ABSTRACT

In a capacitive discharge ignition system there being a first circuit detecting the voltage across the storage capacitor marking the onset of discharge of the storage capacitor, a second circuit detecting the voltage across the storage capacitor marking the substantially complete discharge of the storage capacitor, a third circuit for measuring the time between the events marked by the first and second circuits, and a fourth circuit for analyzing the measured time to determine conditions in the ignition system.

7 Claims, 4 Drawing Sheets

DIAGNOSTIC SYSTEM FOR CAPACITIVE DISCHARGE IGNITION SYSTEM

FIELD OF THE INVENTION

This invention relates to capacitive discharge ignition systems for industrial internal combustion engines wherein the charge on a capacitor is switched to a spark plug circuit. This invention has particular application to ignition systems for stationary engines fueled by the natural gas which is being pumped by pumps driven by the engines. The invention may relate to low tension ignition systems wherein a coil is associated with each spark plug located close to the spark plug. This invention may further involve distribution from a single capacitor to two or more spark plugs. It may further involve the use of more than one capacitor to allow for complete charging between discharges. It further may involve magnetic pickup pulses attached to the flywheel of an internal combustion engine for generating trigger pulses for causing discharge of the capacitor or capacitors to the spark plug circuit.

BACKGROUND OF THE INVENTION

In low tension distribution ignition systems, there is one ignition coil per spark plug. In a typical application, these systems are required to operate on an essentially continuous basis with minimal down time. While the incorporation of diagnostic functions into ignition systems has become commonplace, these have generally been directed to system functions on a global basis, that is, magnetic pickup signals, programming errors and failed components. Products are offered which provide a diagnostic message on an individual cylinder basis for open coil primary faults. Since the ignition system components most often requiring service or replacement are on the secondary side of the ignition coil, that is, the spark plug, the secondary wire, the insulating boots, etc., the ability to monitor the secondary side is highly desirable. Unfortunately, existing means of monitoring and analyzing the performance and/or condition of these components is either costly or impractical and may require an oscilloscope with high voltage probe, a pulse transformer on the secondary wire, a flame ionization detector in the cylinder and so forth. It is an advantage, according to this invention, that it requires none of the above equipment and is relatively low in cost. The secondary (and primary) diagnostic function uses the measured voltage of the storage capacitor to capture discharge time to detect the presence of certain conditions requiring attention and generates the appropriate diagnostic messages.

U.S. Pat. No. 5,208,540 entitled "Ignition Performance Monitor and Monitoring Method for Capacitive Discharge Ignition Systems" uses electrical current sensing on the primary side of a low tension capacitive discharge ignition system to determine the time period during which current generated in the primary winding takes to decay to zero and uses this to calculate and indicate the firing voltage to fire a given spark plug. However, this patent makes no disclosure for a means to detect an open primary, a primary shortage, a capacitor not charged, an open secondary or a shorted secondary.

SUMMARY OF THE INVENTION

Briefly, according to this invention, there is provided a capacitive discharge ignition system having at least one spark plug circuit comprising at least one each storage capacitor, ignition coil and spark plug and electrical connections therebetween. The energy stored on the storage capacitor is, in response to a trigger pulse, switched to the primary side of the ignition coil to induce high voltage in the secondary side of the ignition coil to generate a spark in the spark plug connected in series with the secondary side of the ignition coil. The diagnostic system for this ignition system comprises a circuit for detecting the voltage on the storage capacitor crossing through a first threshold, for example, near 80% of full charge voltage, for marking the onset of discharge of the storage capacitor and generating a first pulse. The diagnostic circuit further comprises a circuit for detecting the voltage across the storage capacitor crossing through a second voltage, for example, near zero, for marking the substantially complete discharge of the storage capacitor and generating a second pulse. A third circuit includes a counter and a clock pulse generator. The counter is responsive to the transition edge of the first and second digital pulses, respectively, for starting and stopping the counter counting pulses delivered by the clock pulse generator. A state machine generates the trigger pulse for discharging the capacitor. Signals move the count accumulated out of the counter and reset the counter prior to the next trigger pulse. A fourth circuit, comprising a microprocessor programmed for analyzing the count accumulated by the counter and transferred to the microprocessor, diagnoses the condition of the spark plug circuit. The diagnosis also includes detecting at least one of the following conditions: open primary, shorted primary, no spark and storage capacitor not charged. It is especially preferred, according to this invention, that the first circuit for detecting the first threshold detects a voltage threshold relative to the fully charged voltage so that the effect of the varying charge voltages necessary for adjustable spark energy can be accommodated. It is noted that the charge voltage on the storage capacitor may be either positive or negative with respect to ground.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENT

Figure 1:
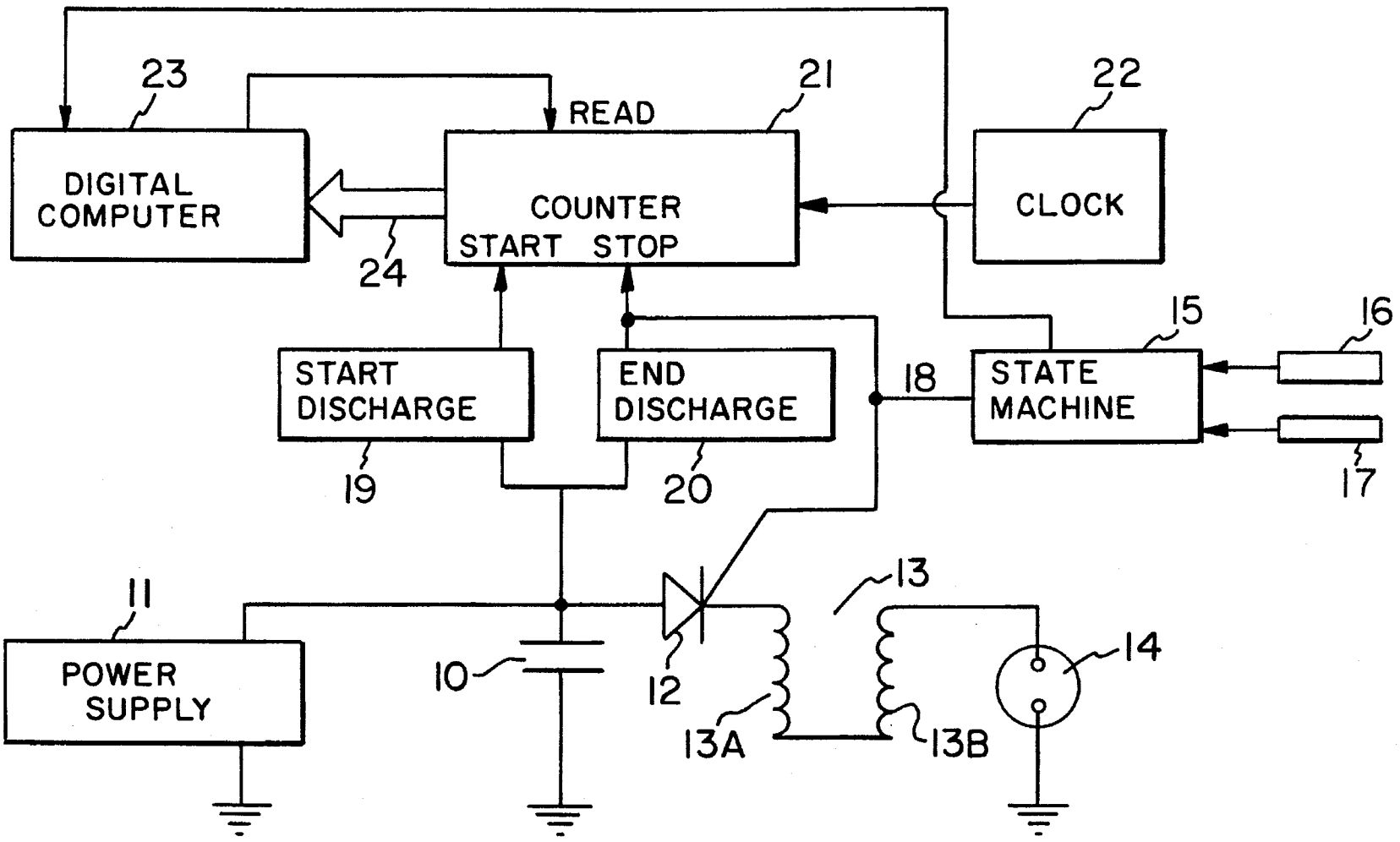
FIG. 1 is a schematic drawing illustrating a capacitive discharge system with a diagnostic circuit according to this invention.

Referring now to FIG. 1, a storage capacitor 10 is charged by a power supply 11. The power supply may comprise a DC-to-DC converter for stepping up a typical 12 or 24 volt input to a voltage typically of about 180 (100–400). A solid state switch 12 is positioned between the primary winding 13A of coil 13 and the storage capacitor. The switch is arranged for discharging the capacitor 10 upon application of a trigger pulse on line 18 provided by a state machine 15. The secondary winding 13B of the coil 13 is in series with the spark plug 14. Discharge of the energy on the capacitor 10 through solid state switch 12 to the primary winding 13A of the coil 13 creates yet a higher voltage in the secondary winding 13A of the coil 13 for generating a spark in the spark plug 14. The state machine 15 is responsive to pulses from pickups 16 and 17. These pulses typically comprise one generated on each revolution of the flywheel by pickup 16 and a plurality of pulses generated by pickup 17 each associated with one of the cylinders of the internal combustion engine. Typically, the pickup pulses are magnetically generated. Other arrangements known to those Skilled in the art may also be employed.

The voltage on the storage capacitor 10 is applied to threshold circuits 19 and 20 where threshold circuit 19 detects the start of discharge of the storage capacitor and threshold circuit 20 detects the end of discharge. Each threshold Circuit generates a high going pulse which is applied to the start and stop inputs of the counter 21. In normal operation, during the period between the leading edges of the Start and stop pulses, clock pulses from clock 22 are counted in a register in counter 21. Upon the stop pulse, the count in the counter register is transferred to an output register in the counter 21. In the case where the storage Capacitor remains charged, the trigger pulse generated by the state machine transfers the count to the output register. The digital computer 23 initiates a read signal to the counter output register which transfers the count in, the output register on bus 24 to the digital computer where the count can be analyzed.

Figure 2:
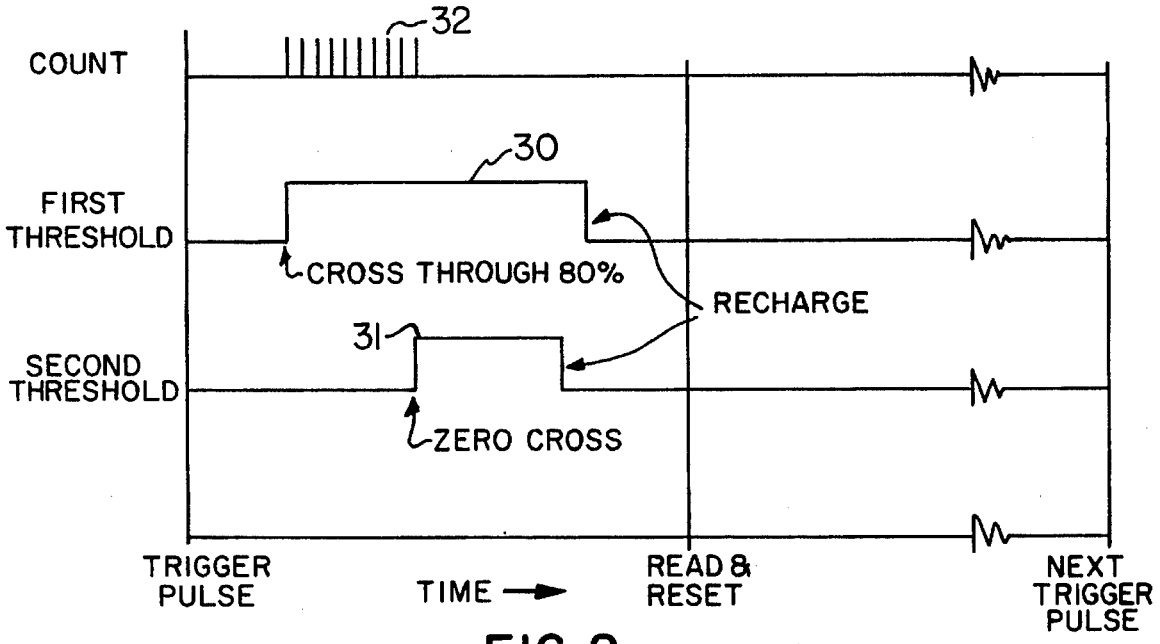
FIG. 2 is a digital signal timing diagram illustrating the operation of the circuit according to FIG. 1.

Referring now to FIG. 2, there is shown a digital signal timing diagram. The first threshold signal 30 goes high a short time after the trigger pulse and remains high until the storage capacitor is recharged. The second threshold signal 31 goes high at approximately the time the storage capacitor is fully discharged and remains high until recharge of the storage capacitor. Between the rising edges of the first and second threshold signals, the count 32 is recorded in the counter. Typically at the time the second threshold signal goes high, the count is transferred to an output register of the counter. Thereafter, on application of a read and reset signal applied to the counter, the output is transferred to the digital computer.

Figure 3:
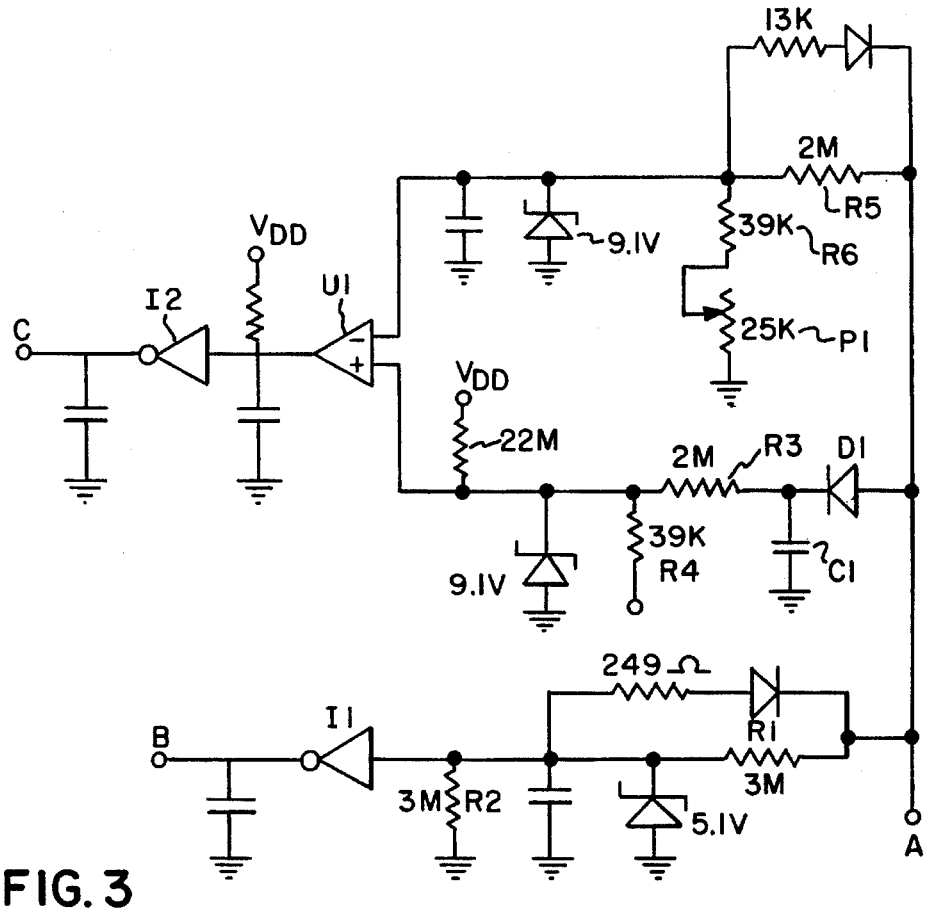
FIG. 3 is a detailed electrical circuit diagram illustrating a preferred embodiment of the threshold detection circuits useful according to this invention.

Referring now to FIG. 3, there is shown a detailed circuit diagram of a preferred embodiment of threshold circuits according to this invention. The voltage on the storage capacitor is applied at point A. The circuit between point A and point B is the second threshold circuit or the zero crossing detection circuit. The voltage on the storage capacitor is divided by resistors R1 and R2 and applied to inverter I1 which has an input threshold near zero volts. When the voltage on the storage capacitor discharges to near zero, the threshold is crossed and the output of the inverter goes high.

Also referring to FIG. 3, the circuit elements between point A and point C comprise the first threshold circuit for detecting the initiation of discharge of the storage capacitor. Diode D1 and capacitor C1 capture and temporarily hold the fully charged voltage of the storage capacitor which is applied across a voltage divider comprising resistors R3 and R4. The fractional voltage across R4 is then applied to the noninverting input of a differential amplifier U1. The instantaneous voltage of the storage capacitor is applied across the voltage divider comprised of resistors R5, R6 and potentiometer P1. The divided voltage across R6 and P1 is applied to the inverting input of differential amplifier U1. Since the lower leg of this voltage divider comprises at least a portion of the resistance across the potentiometer P1, the fractional voltage at the junction of R5 and R6 will be greater than the fractional voltage at the junction of resistors R3 and R4. When the voltage at the inverting input drops below the voltage in the noninverting input of differential amplifier U1, the output is pulled low and the inverter I2 generates a high output pulse at C. Adjustment of the potentiometer permits for adjustment of the fractional value of storage capacitor voltage which must be reached to cause the first threshold circuit to go high.

Figure 4:
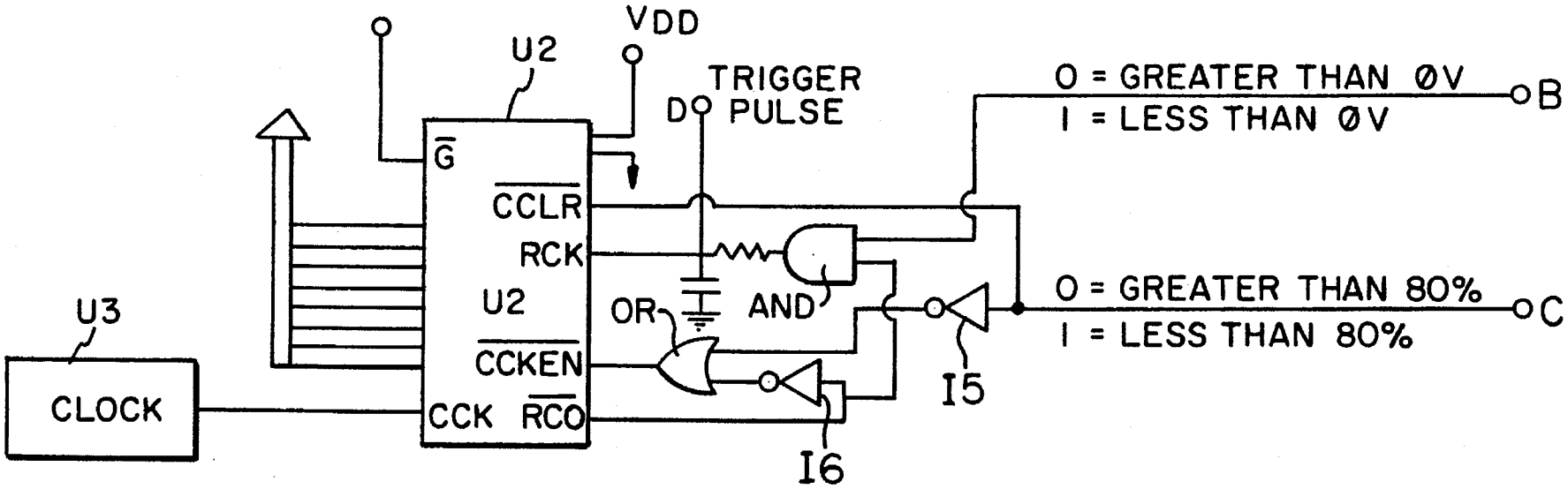
FIG. 4 is a detailed electrical circuit diagram illustrating the operation of the counter according to a preferred embodiment of this invention.

Referring now to FIG. 4, the counter U2 is, according to this preferred embodiment, a high speed CMOS eight-bit counter/register fabricated with silicon gauge CMOS technology. The manufacture's number is TC74HC590A. The internal counter counts on the positive going edge of the counter clock (CCK) when counter clock enable ( $\overline{CCKEN}$) is low. When the counter clear ($\overline{CCLR}$) is low, the internal counter is cleared asynchronously to the clock. The data in the internal counter is loaded into the output register at the positive going edge of the register clock (RCK) and the registered outputs are controlled by enable input ($\overline{G}$). Ripple carry out from the eight-bit counter register is at output ($\overline{RCO}$). The first threshold input is applied at C and inverted through inverter I5 and applied to or gate OR, the output of which is applied to the counter clock enable input ($\overline{CCKEN}$). The carry out from the counter ($\overline{RCO}$) is applied to the other input of the or gate OR through an inverter I6. Thus, when for some fault condition the count reaches maximum, it is not allowed to roll over in the counter register. The second threshold is applied at B to an AND gate along with the ripple carry out from the counter chip. Thus, if the count has reached maximum and the ripple carry out is low, the second threshold signal pulse can have no effect. Under normal operations when the second threshold goes high because the storage capacitor has discharged, the count is caused to be transferred to the output register. In the fault case where the storage capacitor does not discharge to zero, the trigger pulse applied at D causes the count to be transferred to the output register. When the storage capacitor is recharged, the first threshold signal at C goes low and when applied to the clear input ($\overline{CCLR}$) of the counter, clears all registers.

Summarizing, the electronic hardware is used to create two time-critical digital waveforms based on the storage capacitor voltage as it discharges through the ignition coil. The first digital signal moves from low to high state when the capacitor voltage falls below 80%, for example, of its charged state as a result of the firing. When the capacitor gets recharged, the signal moves back to a low state. This signal is referred to as the first threshold or 80% signal. The second digital signal moves from a low to a high state when the capacitor is essentially fully discharged due to firing. This transition occurs when the capacitor falls below about two volts. When the capacitor gets recharged and its voltage rises again above two volts, this signal moves back to a low state. This signal is referred to as the second threshold signal or the zero crossing signal.

A counter having a fixed frequency input is used to measure the time between the rising edge of the 80% signal and the rising edge of the zero crossing signal. The resulting counts provide a time measurement which is the basis of the diagnostics explained hereafter. The low state of the 80% signal indicates the capacitor is charged. The low signal activates the counter clear function which holds the counter at zero whenever the 80% signal is low.

A fire or trigger pulse is generated by the ignition state machine when a spark plug firing is desired. The rising edge of this fire pulse is also used to clock the counter data into the output register to enhance the capabilities of the diagnostics. Normally, the capacitor is charged and the counter is held at zero when the fire pulse occurs. A short time later, a normal firing causes a high signal on the 80% signal which allows the counter to begin counting. A short time later, the zero crossing signal moves high and clocks the appropriate count into the output register. This count represents the time between the rising edges of the 80% signal and the zero crossing signal.

If the capacitor was not charged when the fire pulse comes, the counter will have data of 255 to be clocked into the output register. This occurs because the 80% line remained high, permitting the counter to count until it was jammed by the ripple carry out. This leaves 255 counts rather than zero counts to be clocked into the output register when the fire pulse comes. This allows the system to identify a failure to fire because of a discharged capacitor. If the ignition tries to fire an open primary output, the 80% signal and the zero crossing signal do not move high and the only data clocked into the output register is the zero value which was clocked by the fire pulse. This enables the system to identify an open primary.

The count value is read from the counter output register for every firing just prior to the next firing. This read is timed by the ignition state machine logic and is written to an array in a dual-port RAM, for example. The dual-port RAM is then read and analyzed from the other port by the microprocessor one time per engine cycle. With this system, the microprocessor can test data from every single firing against the thresholds which trip the diagnostics with only a limited amount of overhead. This entire task can be performed in real time by a microprocessor as well.

In order to flag or identify a diagnostic condition, it is preferable if the current count value and the previous count value for a given cylinder both violate the threshold which is specific to the condition being diagnosed. There are currently three low thresholds and three high thresholds which are tested.

Figure 5:
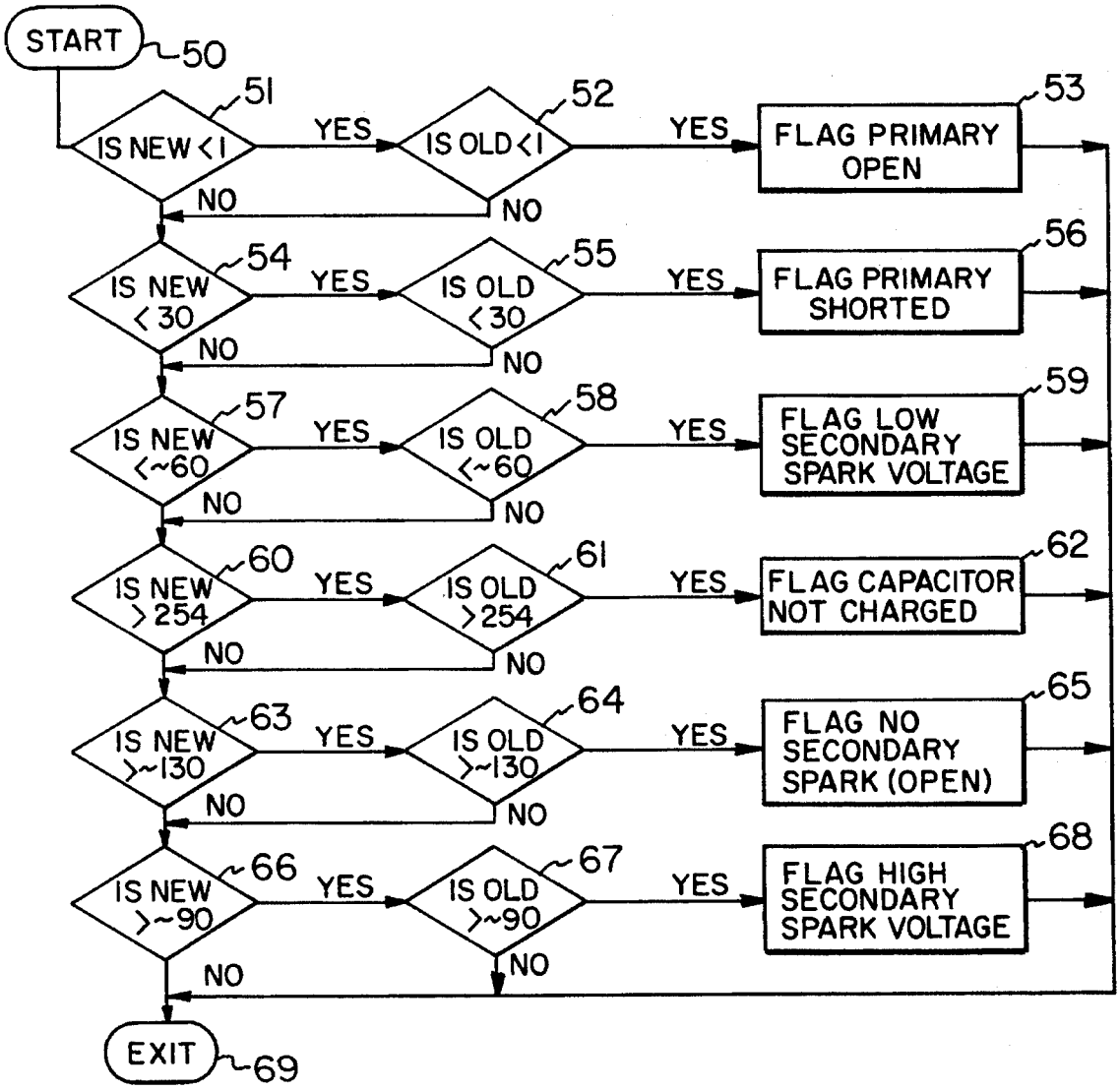
FIG. 5 is a flow diagram for a computer program for controlling the operation of the microprocessor according to a preferred embodiment of this invention.

Referring to FIG. 5, there is shown a flow diagram for a computer program that performs the diagnosis. The program is entered at 50. At 51 the count is tested for being less than 1. If yes, the previous count is tested for being less than 1. If both yes, the primary open flag is set at 53. If otherwise, at 54 the count is tested to determine if it is less than 30 and if yes, the previous count is likewise tested. If both counts are less than 30, the primary shorted flag is set at 56. If otherwise, then at 57 the count is tested for greater than about 60. If yes, the previous count is tested for greater than about 60. If both are yes, then the low secondary voltage spark flag is set at 59. If otherwise, then the count is tested at 60 for being greater than 254. If yes, and the previous count was greater than 254, the capacitor not charged flag is set at 62. If otherwise, the count is tested at 63 for greater than about 130. If yes, the previous count is tested for the same and if both are yes, then the no secondary spark or open secondary flag is set at 65. If otherwise, the count is tested at 66 for greater than about 90. If yes, the previous count is likewise tested and if both are yes, the high secondary spark voltage flag is set at 68. By reference to these flags, the computer can output a digital display indicating the fault condition.

The numerical values counts set forth in the previous explanation of the computer flowchart are illustrative only and depend, of course, upon the particular system and the frequency of the clock pulse generator. Typical conditions and measurement times are set forth in the following table.

| Typical Conditions | Measurement Times |
|---|---|
| Shorted Secondary | 28 microseconds |
| Low Demand (5 KV) | 29 microseconds |
| Normal Demand (15–25 KV) | 30 to 34 microseconds |
| Excessive Demand (greater than 30 KV) | 36 microseconds |
| Open Secondary | 84 microseconds |
| Shorted Primary | 8 microseconds |
| Open Primary | No count |
| Shorted Capacitor | Overflow |

Having thus described the invention with the detail and particularity required by the Patent Laws, what is desired to be protected by Letters Patent is set forth in the following claims.

What is claimed is:

1. In a capacitive discharge ignition system having at least one spark plug circuit comprising a storage capacitor, an ignition coil and a spark plug and electrical connections therebetween and wherein energy stored on said storage capacitor is, in response to a trigger pulse, switched to the primary side of said ignition coil to induce high voltage in the secondary side of the ignition coil to generate a spark in said spark plug connected in series with the secondary side of the ignition coil, the improvement comprising:

first circuit means detecting the voltage across the storage capacitor crossing through a first threshold voltage for marking the onset of discharge of the storage capacitor, second circuit means detecting the voltage across the storage capacitor crossing through a second threshold voltage for marking the substantially complete discharge of the storage capacitor, third circuit means for measuring the time between the events marked by the first and second circuit means, and fourth circuit means for analyzing the measured time to determine the conditions of the primary and secondary circuits of the ignition coil including the spark plug circuit.

2. The improvement according to claim 1, wherein the fourth circuit means is a programmed digital computer which interprets the time for detecting fault conditions in the spark plug circuit.

3. The improvement according to claim 1 or 2, wherein the fourth circuit means interprets the time to detect at least one of the following fault conditions: open primary, shorted primary, no spark and storage capacitor not charged.

4. The improvement according to claim 1 or 2, wherein the first circuit means repeatedly establishes a first threshold voltage relative to the fully charged voltage of the storage capacitor.

5. The improvement according to claim 1 or 2, wherein the said first and second circuit means to detect the storage capacitor voltage is made by a connection and measurement at the ignition coil primary.

6. The improvement according to claim 1 or 2, wherein the third circuit means includes a counter and a clock pulse generator, said counter responsive to the transition edges of the first and second circuit for respectively starting and stopping the count of the said clock pulses.

7. The improvement according to claim 1 or 2, wherein the fourth circuit means uses the accumulated count of the third circuit means for detecting fault conditions in the primary and/or secondary circuit.

* * * * *

UNITED STATES PATENT AND TRADEMARK OFFICE

CERTIFICATE OF CORRECTION

PATENT NO. : 5,623,209

DATED : April 22, 1997

INVENTOR(S) : Joseph M. Lepley and Gary A. Kleinfelder

It is certified that error appears in the above-indentified patent and that said Letters Patent is hereby corrected as shown below:

Column 3 Line 13 "those Skilled" should read --those skilled--.

Column 3 Line 18 "threshold Circuit" should read --threshold circuit--.

Column 3 Line 21 "the Start and stop" should read --the start and stop--.

Column 3 Line 25 "storage Capacitor" should read --storage capacitor--.

Column 3 Line 28 "the count in, the" should read --the count in the--.

Signed and Sealed this

Nineteenth Day of August, 1997

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,623,209

DATED : April 22, 1997

INVENTOR(S) : Joseph M. Lepley and Gary A. Kleinfelder

It is certified that error appears in the above-indentified patent and that said Letters Patent is hereby corrected as shown below:

Column 5 Line 48 "greater than" should read --less than--.

Column 5 Line 49 "greater" should read --less--.

Signed and Sealed this

Tenth Day of February, 1998

*Attest:*

*Attesting Officer*

BRUCE LEHMAN

*Commissioner of Patents and Trademarks*